US005582683A

United States Patent [19]

Bonsu et al.

[11] Patent Number: 5,582,683

[45] Date of Patent: Dec. 10, 1996

[54] METHOD FOR THE RECOVERY OF CHEMICAL VALUES FROM BLACK LIQUOR IN MULTIPLE STREAMS OF DIFFERENT CHEMICAL VALUES

[75] Inventors: Alexander K. Bonsu, Greeley Pike, Pa.; Raymond P. Thorman, Bergen; M. C. Matthew, Morris Plains, both of N.J.

[73] Assignee: International Paper Company, Purchase, N.Y.

[21] Appl. No.: 229,594

[22] Filed: Apr. 19, 1994

[51] Int. Cl.[6] ..... D21C 11/00

[52] U.S. Cl. ..... 162/30.1; 162/35; 162/43; 162/82; 162/90; 423/DIG. 3; 423/428; 423/642

[58] Field of Search ..... 162/30.1, 30.11, 162/29, 35, 37, 43, 82, 90; 422/185; 423/428, 642, 196, 198, 201, DIG. 2

[56] References Cited

U.S. PATENT DOCUMENTS

| | | | |
|---|---|---|---|
| 1,795,557 | 3/1931 | Hagglund | 92/2 |
| 1,949,669 | 3/1934 | Wells | 162 X/29 |
| 3,236,589 | 2/1966 | Reinhall et al. | 423 X/428 |
| 3,322,492 | 5/1967 | Flood | 23/46 |
| 3,366,535 | 1/1968 | Cann | 162/30 |
| 3,523,864 | 8/1970 | Osterman et al. | 162/30 |
| 3,617,434 | 11/1971 | Nakafuri et al. | 162/30.11 |
| 4,011,129 | 3/1977 | Tomlinson, II et al. | 162/30 |
| 4,053,352 | 10/1977 | Hultman et al. | 162/29 |
| 4,098,639 | 7/1978 | Noreus et al. | 162/30.1 |
| 4,303,469 | 12/1981 | DiNovo et al. | 162/30 |
| 4,668,342 | 5/1987 | Blackwell | 162/30.11 |
| 4,682,985 | 7/1987 | Kohl | 48/197 R |
| 5,340,440 | 8/1994 | Henricson | 162/31 |

FOREIGN PATENT DOCUMENTS

| | | |
|---|---|---|
| 990476 | 6/1976 | Canada . |
| 1174014 | 9/1984 | Canada . |
| 483068 | 9/1929 | Germany . |
| 53-081702 | 7/1978 | Japan . |

OTHER PUBLICATIONS

Recovery of Sodium Hydroxide from Alkaline Pulping Liquors by Autocausticising Part I, General Aspects; Paperi ja Puu—Paper och Tra, vol. 60, No. 3, 1978, pp. 129–132.

Recovery of Sodium Hydroxide from Alkaline Pulping Liquors by Smelt Causticizing, Part II, Reactions Between Sodium Carbonate and Titanium Dioxide, Paper ja Puu–Papper och Tra, No. 5, 1979, pp. 394–401.

Recovery of Sodium Hydroxide from Alkaline Pulping Liquors by Smelt Causticizing, Part III, Alkaline Distribution in Titanium Dioxide Causticizing, Paperi ja Puu–Papper och Tra, No. 6–7, 1979, pp. 453–464.

Recovery of Sodium Hydroxide from Alkaline Pulping Liquors by Smelt CAusticizing, Part IV, Comparison of Various Causticizing Chemicals, Paperi ja Puu–Papper och Tra, No. 10, 1979, pp. 639–650.

Recovery of Sodium Hydroxide from Alkaline Pulping Liquors by Autocausticising Part V, Causticizing of Molten Sodium Carbonate with Ilmenite, No. 9, 1979, pp. 564–577.

Recovery of Sodium Hydroxide from Alkaline Pulping Liquors by Causticizing Molten Sodium Carbonate with Amphoteeric Oxides, Paper ja Puu–Papper och Tra, No. 5, 1980, pp. 339–350.

Autocausticizing of Kraft Black Liquor: Process Implications BAsed on Chemical Equilibrium Calculations, 1990 Pulping Conference, pp. 897–903.

Kraft Black Liquor Combustion and Direct Causticizing with Titanium Dioxide, 1991 Pulping Conference, pp. 299–308.

Improved Kraft Pulping by Controlled Sulfide Additions, Seventh ISWPC, Mar. 25–28, 1993, Beijing, China, pp. 337–347.

*Primary Examiner*—Donald E. Czaja
*Assistant Examiner*—Calvin Padgett
*Attorney, Agent, or Firm*—Paul E. Hodges, P.C.

[57] ABSTRACT

A method for the recovery of chemical values from spent lignocellulosic pulping liquor salts to produce white liquor of different sulfidities. Preferably, the white liquor is in the form of separate liquid streams, each of which is of a sulfidity that is different from the sulfidity of others of the streams. The method also provides for developing a white liquor stream which is essentially free of sulfide values, but which contains sodium hydroxide. Further, the method provides for recovery of titanium values for recycling.

15 Claims, 3 Drawing Sheets

METHOD FOR THE RECOVERY OF CHEMICAL VALUES FROM BLACK LIQUOR IN MULTIPLE STREAMS OF DIFFERENT CHEMICAL VALUES

FIELD OF THE INVENTION

This invention relates to the recovery of chemical values from the black liquor from a kraft cellulosic pulp digester for reuse in the digesting of wood to make pulp and/or other uses in a papermaking process, and more specifically to the recovery of the chemical values as multiple streams, each of which has different quantities of one or more of the chemical values which are recovered from the black liquor.

BACKGROUND OF INVENTION

It has been proposed in the prior art that the pulping of cellulosic chips in a digester, employing the kraft process, may be enhanced through "sulfide profiling", a procedure in which the white liquor containing the pulping chemicals is introduced to the digester in the form of a plurality of separate inlet streams of white liquor. The sulfidity of each inlet stream is adjusted to a predetermined value and each inlet stream is introduced to the digester at a location at which the white liquor of adjusted sulfidity is optimally efficient in digestion of the wood. The prior art suggests that each inlet stream of white liquor be "made up" by mixing selected amounts of sodium hydroxide and sodium sulfide compound(s) with a solvent, such as water. That is, one would use raw chemicals to make up each inlet stream. The expense and time required to thusly make up, store and dispense separate inlet streams for a digester makes it impractical to employ sulfide profiling as proposed in the prior art. Moreover, the addition of raw chemicals upsets the "chemical balance" of the pulping and/or recovery operations, and to maintain operations, purge points would be needed.

In the kraft cellulosic pulping process, the black liquor from the digester contains considerable chemical values (at times referred to as "process salts") which desirably are recovered and reused within the papermaking process. Process salts contained in the black liquor from a kraft process digester include sodium sulfate and sodium carbonate. It is taught in the prior art that black liquor from a kraft pulp digester may be introduced, along with an amphoretic oxide such as $TiO_2$, and air into a fluidized bed reactor (FBR) to produce a cake which contains the process salts from the black liquor. Zou et al., in their publication entitled: "Kraft Black Liquor Combustion and Direct Causticization with Titanium Dioxide", TAPPI Proceedings, 1991 Pulping Conference, pp. 299–308, which publication is incorporated herein by reference, provide a discussion of this prior art process for reacting kraft black liquor with $TiO_2$ in a fluidized bed, including the chemistry involved. Generally stated, in this prior art process direct causticizing (at times referred to as "autocausticizing") of the process salts takes place in the FBR as a reaction between the sodium carbonate and the titanium dioxide to form an intermediate sodium titanate. Further, within the FBR the sulfur compounds in the black liquor are oxidized to sulfate. The pertinent result is the formation in the FBR of a cake which comprises a mixture of sodium sulfate and sodium titanate. In the prior art, this cake, preferably while in the solid state, is treated with a reductant to convert the sulfates in the cake to sulfides. The inorganic chemical values in the reduced cake thus include sodium sulfide and sodium titanate ($4Na_2O.5TiO_2$). The sodium sulfide is in the form of solid particulates that are integrally mixed with the solid sodium titanate. The sodium in the sodium titanate is chemically complexed and may be recovered from the reduced salts only through a chemical reaction.

In the prior art, the reduced "fresh salts" are leached with water to extract and solubilize the sodium sulfide from the solid salts and, through hydrolysis, to produce sodium hydroxide and $Na_2O.3TiO_2$. The sodium hydroxide enters into solution and the $Na_2O.3TiO_2$ is a solid residue which can be dewatered and recycled to the black liquor entering the FBR. The filtrate from the leaching procedure of the prior art black liquor recovery process is collected as a single stream of white liquor which contains sodium hydroxide and sodium sulfide. The sulfidity of this single stream is commonly about 30%.

It will be apparent that in this prior art, there is no possibility of using the single filtrate stream containing sodium hydroxide and sodium sulfide in a sulfidity-profiling pulp digestion process which requires multiple white liquor infeed streams, each of which has a sulfidity value which is different from the sulfidity value of each other infeed stream. Further, in the prior art, the recovery process provides only for an outlet stream which contains both sodium sulfide and sodium hydroxide so that the outlet stream is useful only for recycling to the digester.

It is an object of the present invention to provide a method for recovering sodium sulfide values and sodium hydroxide values from a kraft black liquor.

It is another object of the present invention to provide a method for recovering chemical values from kraft black liquor in multiple streams containing recovered chemical values which are useful as inlet streams to one or more of the operations of a papermaking process.

It is another object of the present invention to provide a method for developing a plurality of inlet streams of reaction chemicals for a cellulosic pulp digester operating in a sulfide profiling mode.

It is another object of the present invention to provide a method for treating a kraft black liquor to develop a plurality of streams containing chemical values recovered from the black liquor, each stream having different chemical values and/or different quantities of one or more of the chemical values in the black liquor.

Other objects and advantages of the present invention will be recognized from the description provided herein, including the claims and drawings in which:

SUMMARY OF THE INVENTION

Figure 1:
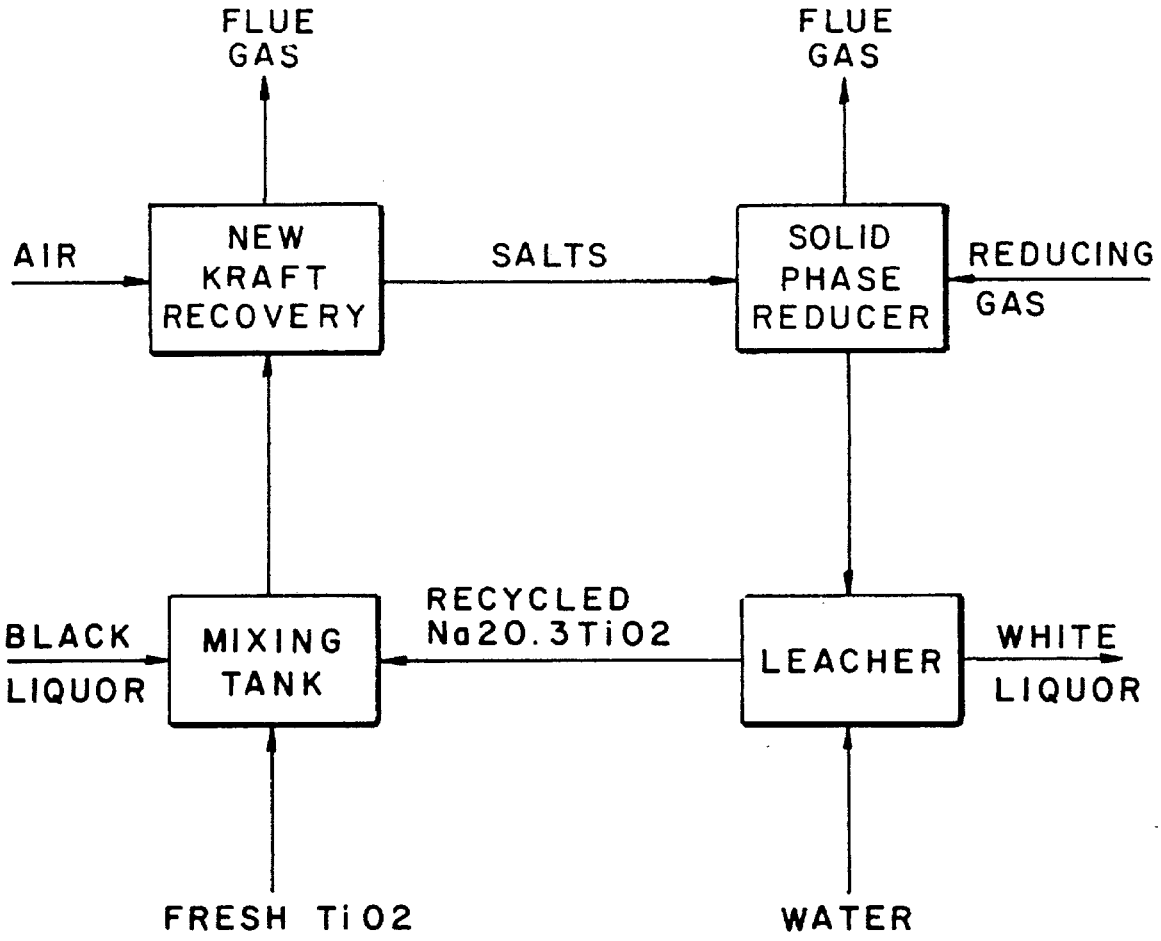
PRIOR ART Fig. 1
FIG. 1 is a schematic diagram of a prior art method for treating a kraft black liquor for recovering chemical values therefrom as a single outlet stream.

In accordance with the present invention, the inventors have discovered that the chemical values from a kraft black liquor may be recovered in forms useful for recycling of the chemical values to one or more of the operations of a papermaking process. These recycled values do not upset the "chemical balance" of the overall papermaking process, and provide substantial economic benefits. In particular, the recovered chemical values may be recycled as inlet feed streams to a cellulosic pulp digester, for example a digester operating in the sulfide profiling mode, and/or to a pulp bleaching operation. The present method comprises the steps of converting the process salts in the black liquor under autocausticizing conditions to a cake and thereafter treating the cake with a reductant to reduce the salts in the cake, including conversion of the sodium sulfate in the cake contacting the reduced process salts from the kraft black liquor, in a plurality of stages, with a solvent, with agitation to form a process stream that contains a portion of the desired chemical values in the process salts, and withdrawing portions of the process stream at selected locations within the process to provide multiple takeoff streams, each having a different value of one or more of the chemical values from the process salts, and recycling these multiple take-off streams to one or more remote papermaking operations.

In accordance with a preferred embodiment of the present invention, in a first stage, the process stream is agitated with the solvent (preferably water) for a time and at a temperature sufficient to develop a process stream in which a portion of the sodium sulfide is washed from the cake and taken up into solution, a portion of the sodium titanate is hydrolyzed to form sodium hydroxide which is also taken up into solution, and a sodium trititanate solid complex is formed. The process stream containing the solubilized sodium sulfide and sodium hydroxide values is filtered between the first stage and a second stage and a portion of the process stream filtrate is withdrawn from this filtering operation as a first take-off stream of first sodium sulfide and sodium hydroxide values, and directed to a remote operation of a papermaking process, such as a kraft digester. In accordance with the discovery of the present inventors, the rate at which the sodium sulfide in the process stream is washed from the remaining solids in the process stream and solubilized into the process stream is greater than the rate at which the sodium titanate is hydrolyzed and sodium hydroxide is formed and solubilized. Thus, through control of the washing and hydrolysis actions, the sulfidity of the process stream can be controlled to produce a plurality of take-off streams, each of which has sulfidity and/or alkalinity values that are different from these values in each of the other take-off streams. The present inventors have combined this discovery with the concept of treating the reduced solid salts, with mixing, in a solvent such as water in a series of stages so that the filtrate from the process stream in the first stage has a first quantity of the sodium sulfide solubilized therein, and a first quantity of the sodium hydroxide solubilized therein. Further, the inventors have found that by adjusting the temperature and residence time of the process stream in a given stage, one can selectively develop a process stream which contains a preselected sulfidity and/or alkalinity. After a given number of stages of treatment, the process stream is depleted of the sodium sulfide, but still contains sodium hydroxide so that the process stream from the final stage of the present method is useful as an infeed stream to a pulp bleaching operation, such as an infeed stream to an extraction stage of a bleaching operation.

Preferably, the process stream is filtered following each reaction stage and a portion of the filtrate is withdrawn as a take-off stream. At each stage, make-up solvent is added to the filtered solids portion of the process stream and this solids-containing portion of the process stream is directed to a subsequent stage where the leaching, conversion, filtration, stream separation, and make-up addition activities are repeated.

In accordance with one aspect of the invention, in each stage, the residence time and the temperature of the process stream is selected to effect extraction of a selected portion of the sodium sulfide from the solids in the process stream during that stage and develop a process stream having a selected degree of sulfidity, and further during that stage to provide the desired conditions for hydrolysis of a portion of the sodium titanate values in the process stream to convert a portion of the sodium titanate to sodium hydroxide which is taken up into solution.

The inventors have further discovered that through recycling a portion of the process stream filtrate to a preceding stage, and the use of the multiple stages, the final stage process stream may be effectively cleared of sodium sulfide, thereby yielding a process stream filtrate which contains only sodium hydroxide as a significant chemical value, the solid sodium trititanate having been filtered from the process stream. Thus, this process stream filtrate is useful for feeding to a pulp bleaching process, for example, as the alkali infeed to an extraction stage in the bleaching process.

The sodium trititanate collected on the filter of the final stage filtration operation is useful for recycling to the kraft black liquor system as a source of titanium dioxide in the FBR.

Generally stated, in the present method, the reduced process salts of the cake are leached with water through not less than two, and preferably not greater than 4 stages. Whereas more than four stages may be used, the marginal increase in chemical value extraction efficiency decreases and becomes uneconomical. The optimum leaching and reaction temperature of the process stream ranges between about 80° C. and about 105° C., and the optimum residence time of the process stream in a stage is between about ⅛ to about 4 hours.

The process stream is agitated at each stage to enhance the effective contact between the solids and solvent which make up the process stream as it enters each stage.

Between stages, the process stream is filtered to separate the solids in the process stream exiting a given stage from the liquid of the process stream. As noted, during the first stage, the temperature and residence time of the process stream in this first stage is limited to that which permits the leaching from the process stream of a preselected quantity of the sulfides. As discovered by the present inventors, this leaching of the sulfides from the process stream is at a rate that results in the solubilization of the sodium sulfide more rapidly than the rate at which sodium hydroxide is formed by the hydrolysis of the sodium titanate. Thus, the inventors provide for the development of a process stream exiting a given stage to have a preselected sulfidity. The filtrate from the filtration operation that follows the first stage, for example, readily can be selected to provide a stream of white liquor of 40% sulfidity or greater exiting this first filtration operation. In accordance with one aspect of the present invention, at least a portion of this filtrate is withdrawn from the filtration operation as a take-off stream and is fed to a remote and different operation of a papermaking process. That portion of the filtrate withdrawn from the process stream is made up by adding to the process stream a quantity of solvent (water) that is equal in volume to that amount of water which is required to maintain the desired concentration of the remaining solids in the process stream. Thereafter, the process stream is directed to a further stage wherein the salts in the process stream are again contacted with water, and thereafter the process stream is filtered and a portion of the filtrate is withdrawn to become a take-off stream that is of different sulfidity than the take-off stream from the preceding stage. Again make-up water is added to the process stream which is then directed to a further stage. The contacting of the process stream with water, with agitation, in stages is continued until the filtrate from a stage is essentially free of sodium sulfide. Thereupon, this filtrate is useful as an infeed stream to a pulp bleaching operation.

In accordance with another aspect of the present invention, that portion of the filtrate stream from a given stage which is not withdrawn as a take-off stream is recycled to the reactor of the stage from which the filtrate originated or as a wash for the filter of the preceding stage. This recycling of a portion of the process stream provides the ability to control the concentration of the sodium sulfide and sodium hydroxide in the various streams.

With reference to FIG. 1 which depicts diagrammatically a prior art process for recovery of the process salts from a kraft black liquor, the black liquor is mixed with fresh $TiO_2$ and recycled $Na_2O.3TiO_2$. This mixture is fed to a FBR where the process salts are extracted in the form of a cake. The cake is treated, as in a solid phase reducer, with a reducing gas and thereafter processed through a leacher, using water as a solvent. Commonly, the leacher comprises multiple stages in which there is full recycle between stages. The single output stream from the leacher normally has a sulfidity of about 30%.

Figure 2:
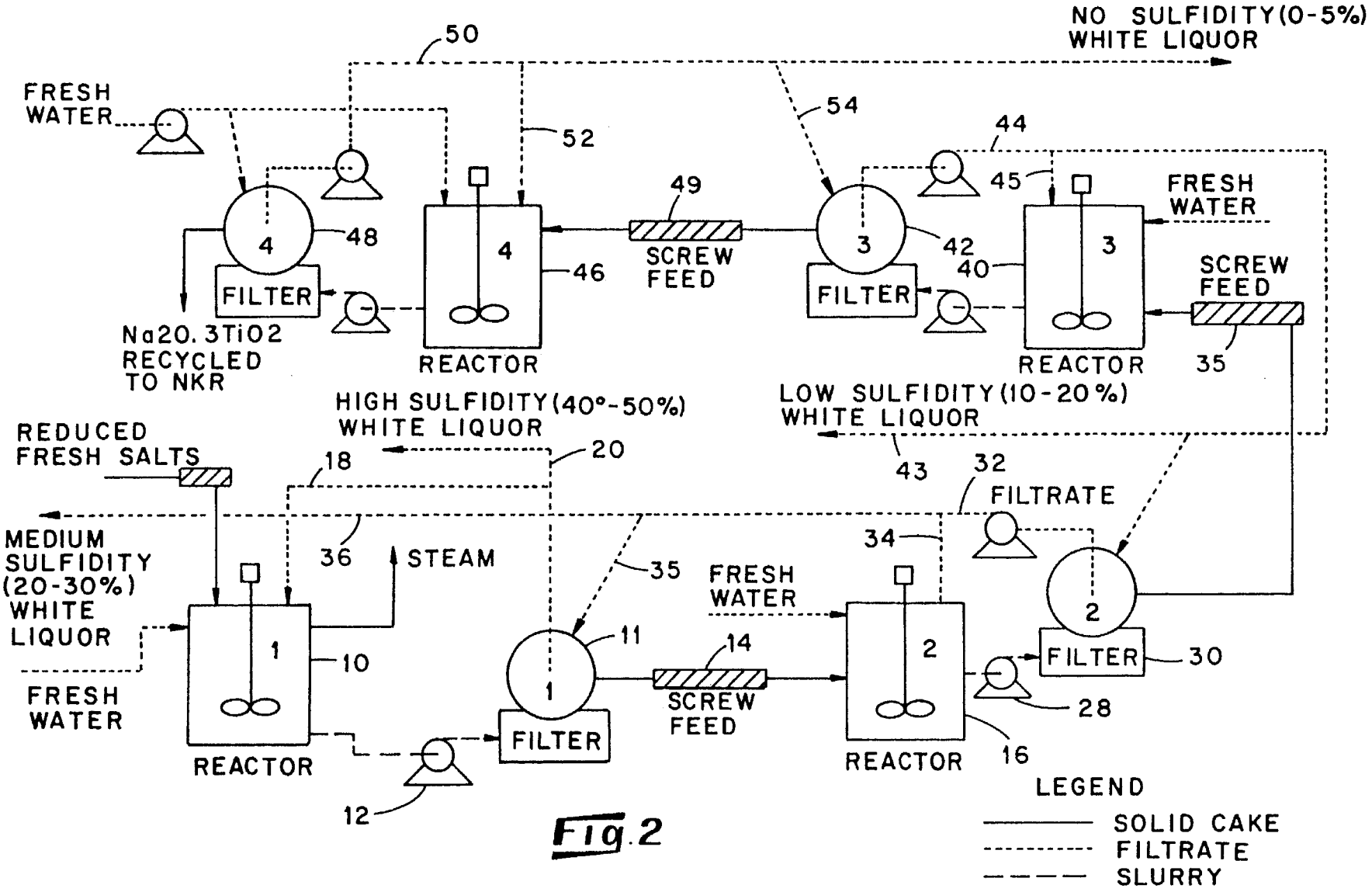
FIG. 2 is a schematic diagram of one embodiment of the method of the present invention; and, FIG. 3 is a schematic diagram of a further embodiment of the method of the present invention.

In the present method, depicted in FIG. 2, the reduced fresh salts from the reducer are fed to a first stage reactor 10 with fresh water. Within this first stage reactor, the salts are agitated in the water for a time and at a temperature at which a portion of the sodium sulfide in the process stream is solubilized and a portion of the sodium titanate is hydrolyzed to form sodium hydroxide and $Na_2O.3TiO_2$, the latter comprising solid particles. Notably, not all the sodium sulfide is extracted from the process salts in the process stream in this first stage reactor, so that a portion of the sodium sulfide remains in the solid state and passes through the first stage reactor as a part of the process stream.

From the first stage reactor, the process stream is fed to a first stage filter 11, as by means of a pump 12, where the solids in the process stream are extracted and fed, as by means of a screw feed 14 to a second stage reactor 16. The filtrate from the first stage filter 10 comprises white liquor and is conveyed from the filter as a first take-off stream, and, optionally, divided into two streams 18 and 20, the first 18 of which is recycled to the first stage reactor and the second 20 of which is conveyed to a remote operation of the papermaking process, such as to a pulp digester. If desired, the entire take-off stream from the first stage filter may be conveyed to the pulp digester, for example. The white liquor filtrate from the first stage filter 10 may have a sulfidity of at least about 40–50% and sodium hydroxide values which permit the white liquor to be used as an infeed stream to the pulp digester.

As noted, the solids extracted by the first stage filter 11 are fed, as by means of the screw feed 14 to the second stage reactor 16. In this second stage reactor, the solids stream, which has been partially depleted of both sodium sulfide and sodium hydroxide values, is again agitated with fresh make-up water to solubilize further sodium sulfide values and to hydrolyze further sodium titanate. The process stream from the second stage reactor is conveyed, as by a pump 28, to a second stage filter 30. The filtrate from this second stage filter comprises white liquor and at least a portion thereof is withdrawn from the process stream as a second take-off stream 32. This second take-off stream may have a sulfidity of about 20–30%. The sodium hydroxide values in this second take-off stream may be more or less than the sodium hydroxide values of the first take-off stream, depending upon the time and temperature conditions prevailing in the first and second stage reactors. For example, at a given temperature, shorter residence time of the process stream in the first reactor, relative to the residence time of the process stream in the second reactor, can be employed to decrease the sodium hydroxide values in the process stream exiting the first stage reactor, thereby increasing the percentage of sodium sulfide values contained in the process stream from the first stage reactor. Contrariwise, by operating the first and second stage reactors at the same temperature and same time of residence of the process stream within each reactor, the extraction of sodium hydroxide values from the process salts in the first stage reactor may be enhanced.

The second take-off stream 32 of white liquor, optionally, may be divided into three portions, the first 34 of which is recycled to the second reactor 16, the second of which is recycled to the first stage filter 11 as wash liquid, and the third 36 of which is conveyed to a remote operation of a papermaking process, such as to a pulp digester.

From the second stage filter 30, the solids stream from the filter is fed as by a screw feed 38 to a third stage reactor 40, with make-up water, agitated for selected time at a selected temperature, and then processed through a third stage filter 42. As in previous stages, at least a portion of the filtrate from the third stage filter is withdrawn as a third take-off stream 44. This third take-off stream commonly will have a sulfidity of about 10–20% and a first portion 43 thereof may be fed directly to a pulp digester, a second portion 45 thereof may be recycled to the third reactor 40, and a third portion 47 of the third take-off stream may be recycled to the second stage filter 30.

In the depicted process, the solids stream from the third stage filter 42 is fed to a fourth stage reactor 46 by means of a screw feeder 49 where the remaining solids in the process stream are agitated with make-up water to effectively extract all remaining sulfide values from the process stream. The process stream from the fourth stage reactor is fed to a fourth stage filter 48 where the only material solids remaining in the process stream are the $Na_2O.3TiO_2$ particles. These solid particles are extracted from the liquid and recycled to the black liquor infeed stream to the FBR. The filtrate from the fourth stage filter 48 is withdrawn as a fourth take-off stream 50. This stream is essentially free of sulfide values, but contains significant sodium hydroxide values, hence the stream is useful as an infeed stream to an extraction stage, or the like, of a pulp bleaching operation. As desired, a first portion 52 of the fourth take-off stream may be recycled to the reactor 46, and/or or a second portion 54 thereof may be recycled to the filter 42.

In one operation employing the method of the present invention, reduced process salts from the black liquor from a kraft cellulosic pulp digester were leached through four stages. The residence time within each stage was 30 minutes. The temperature of the process stream was maintained at 100° C. through all four stages. Analysis of the leachate from these four stages showed. sulfidities of 40%, 12%, 10% and 0% for the first, second, third and fourth stages, respectively. The leachate from the several stages, upon analysis, showed sodium hydroxide values of 60.3, 140.7, 151.5 and 77.5 g/1 as $Na_2O$ for the first through the fourth stages, respectively, thereby indicating the difference in the rates of change in the sulfidity and alkalinity of the process stream between the several stages.

In a further operation employing the method of the present invention, reduced process salts from the black liquor from a kraft pulp digester were also leached through four stages. In this operation, the temperature of the process stream was held at about 100° C. The residence time in the first stage was seven minutes, with the residence time in each of the second, third and fourth stages being of 30 minutes duration. The sulfidity of the leachate from each of the several stages was determined to be 44.4%, 9.3%, 3.5% and 0% respectively, for the first through the fourth stages, thereby providing for a shifting of the sodium hydroxide from the first stage to subsequent stages, with the result that the sulfidity of the process stream from the first stage was increased and reduced in subsequent stages.

Figure 3:
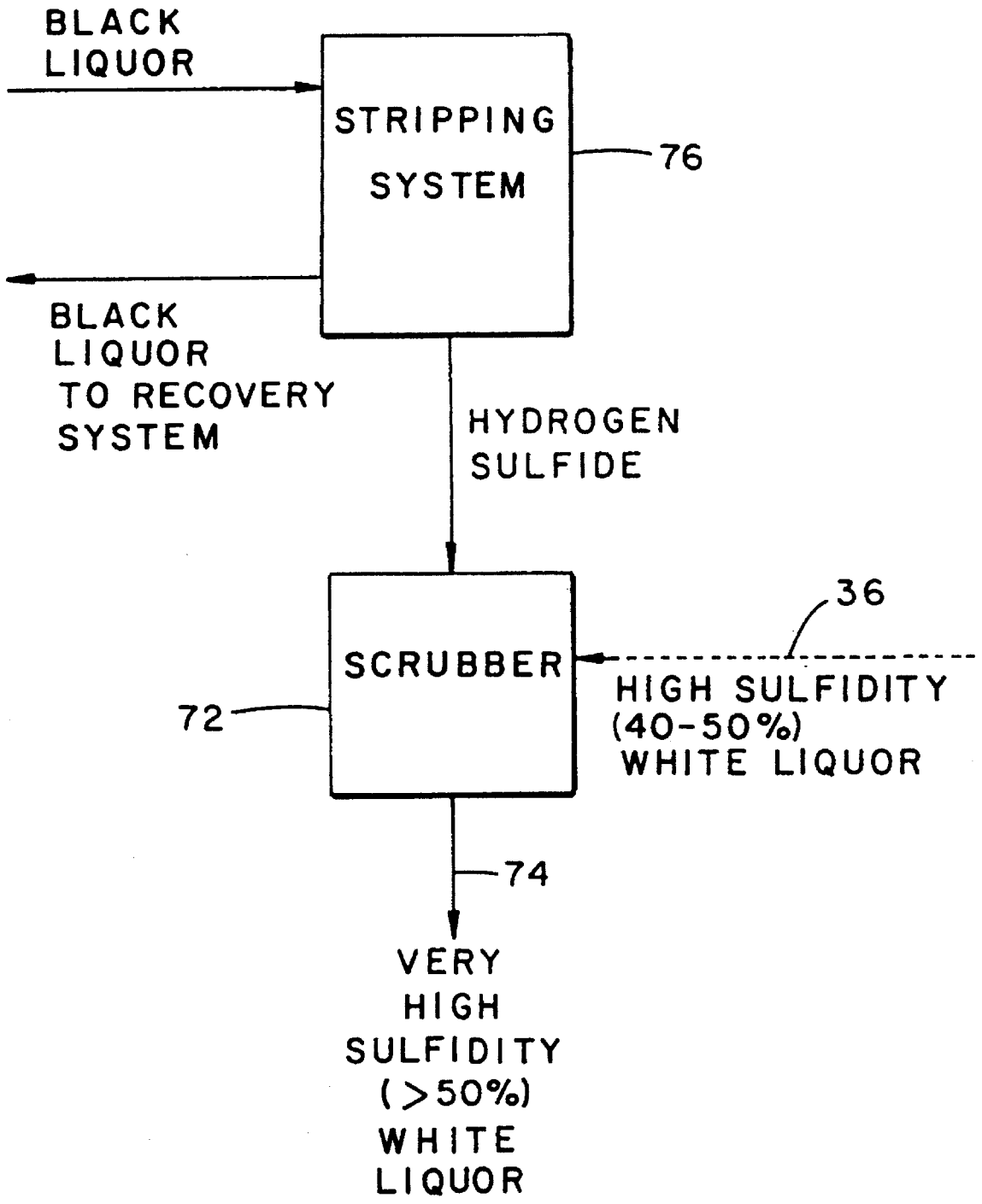

In a further embodiment of the present invention, as depicted in FIG. 3, the sulfidity of any one of the take-off streams from the process stream may be increased, if desired, to a value in excess of 60%. In this embodiment of the present invention, the black liquor from the pulp digester (not shown) is processed through a stripping system 70 wherein hydrogen sulfide is stripped from the black liquor. The liquid take-off stream from one of the stages described hereinabove, such as the first take-off stream 36, is then used as the scrubbing liquid for a scrubber 72 for the hydrogen sulfide that is stripped from the black liquor, thereby causing the take-off stream to pick up additional sulfide values. This resultant high-sulfide white liquor stream 74 is useful as an infeed stream to a pulp digester as described hereinabove for other take-off streams. It is to be noted that the sulfidity of the first take-off stream of the present system has a sulfidity value which is greater than the sulfidity value of the single take-off stream obtained from leacher of the prior art as depicted in FIG. 1, that is, at least 40% sulfidity of the first take-off stream of the present invention versus 30% sulfidity of the single take-off stream of the prior art.

What is claimed:

1. In a method for the recovery of chemical values from a black liquor from a kraft cellulosic pulp digesting operation wherein the chemical values in the black liquor are converted to solids comprising sulfide values and sodium values, the improvement comprising the steps of contacting said solids with water in a first stage reactor, with agitation, to produce a process stream in which a portion of said sulfide values are solubilized and a portion of said sodium values are converted to sodium hydroxide and are solubilized, extracting from said process stream at least a portion of the liquid phase thereof as a first take-off stream having a first sulfidity value, adding make-up water to said process stream and contacting the solids remaining in said process stream in a second stage reactor, with agitation, to provide a process stream as a strain in which a further portion of said sulfide values are solubilized and a further portion of said sodium values are converted to sodium hydroxide and solubilized, extracting from said process stream at least a portion of the liquid phase thereof as a second take-off stream having a second sulfidity value, and directing said first and second take-off streams to one or more remote papermaking operations such as pulp digestion, pulp bleaching and like papermaking operations that are physically separate from said first and second stage reactors as infeed streams to such remote papermaking operations.

2. The method of claim 1 and including the steps of further contacting said process stream with make-up water in one or more further reactors to extract further portions of said sulfide and said sodium values from said process stream.

3. The method of claim 1 wherein said solids from said black liquor include a sodium titanate complex and wherein said contacting said solids with water hydrolyzes said sodium titanate complex to form sodium hydroxide which is solubilized and amphoteric oxide which remains in the process stream as solid particles, and including the further steps of extracting said solid particles of amphoteric oxide from the process stream and recycling said solid particles to said black liquor as a source of amphoteric oxide to said black liquor in preparation for the treatment of said black liquor for the conversion of chemical values contained therein to solid form.

4. The method of claim 1 and including the step of directing at least one of said first and second take-off streams from said process stream to a hydrogen sulfide scrubber as a scrubbing liquid therein whereby the sulfidity of said at least one of said take-off streams is increased.

5. The method of claim 1 wherein said solids comprising sulfide and sodium values are processed through not more than four stages.

6. The method of claim 1 wherein the sulfidity value of said first take-off stream is at least 40%.

7. The method of claim 1 wherein the residence time of said process stream within each stage is between about one-eighth hour and about four hours.

8. The method of claim 1 wherein the temperature of said process stream within each stage is between about 80° C. and about 105° C.

9. The method of claim 1 wherein said process stream is processed through sufficient stages to reduce the sulfidity of said process stream to less than 3.5 percent.

10. The method of claim 9 wherein said process stream having less than 3.5 percent sulfidity has sufficient sodium hydroxide values to make said process stream useful as an infeed stream to a cellulosic pulp bleaching operation.

11. The method of claim 1 and including the steps of recycling at least a portion of the take-off stream from at least one of said stages to a preceding stage of the at least one of said stages.

12. The method of claim 1 wherein the sodium hydroxide value of said first take-off stream is less than the sodium hydroxide value of said second take-off stream.

13. The method of claim 2 wherein said process stream is processed through at least three reactors.

14. The method of claim 13 wherein said sodium hydroxide value of the take-off stream from any reactor downstream of the third reactor is less than the sodium hydroxide value of the take-off stream at or upstream of the third reactor.

15. The method of claim 13 wherein the sulfidity values of each of the take-off streams from said reactors each decreases from the first through the final reactor.

* * * * *

UNITED STATES PATENT AND TRADEMARK OFFICE

CERTIFICATE OF CORRECTION

PATENT NO. : 5,582,683

DATED : December 10, 1996

INVENTOR(S) : Alexander K. Bonsu, Roymond P. Thorman and M.C. Matthew

It is certified that error appears in the above-indentified patent and that said Letters Patent is hereby corrected as shown below:

Column 6 line 61 "g/l" should be --g/l--.

Column 7 line 52 "strain" should be --stream--.

Signed and Sealed this

Fourth Day of March, 1997

*Attest:*

*Attesting Officer*

BRUCE LEHMAN

*Commissioner of Patents and Trademarks*